United States Patent [19]

Furumichi et al.

[11] Patent Number: 4,920,984

[45] Date of Patent: May 1, 1990

[54] MOUTHPIECE AND METHOD FOR PRODUCING THE SAME

[75] Inventors: Hiroshi Furumichi; Takao Makishima, both of Osaka, Japan

[73] Assignee: Sunstar Kabushiki Kaisha, Osaka, Japan

[21] Appl. No.: 108,677

[22] Filed: Oct. 15, 1987

[30] Foreign Application Priority Data

Oct. 15, 1986 [JP] Japan ..... 61-246045
Oct. 15, 1986 [JP] Japan ..... 61-246046

[51] Int. Cl.[5] ..... A61F 5/56

[52] U.S. Cl. ..... 128/861; 128/862; 433/6

[58] Field of Search ..... 128/136, 859, 860, 861, 128/862; 433/71

[56] References Cited

U.S. PATENT DOCUMENTS

| | | | |
|---|---|---|---|
| 2,706,478 | 4/1955 | Porter | 128/136 |
| 3,073,300 | 1/1963 | Berghash | 128/862 |
| 3,303,844 | 2/1967 | Johnson et al. | 128/136 |
| 3,407,808 | 10/1968 | Baldwin | 128/136 |
| 3,411,501 | 11/1968 | Greenberg | 128/136 |
| 3,943,924 | 3/1976 | Kallestad et al. | 128/136 |
| 4,185,817 | 1/1980 | Peterson | 272/95 |
| 4,419,992 | 12/1983 | Chorbajian | 128/136 |
| 4,624,640 | 11/1986 | Tesini | 433/71 |

FOREIGN PATENT DOCUMENTS

| | | |
|---|---|---|
| 0105596 | 4/1984 | European Pat. Off. . |
| 2276071 | 1/1976 | France . |
| 61-100273 | 5/1986 | Japan . |
| 1527685 | 10/1978 | United Kingdom . |
| 2004559 | 4/1979 | United Kingdom . |

*Primary Examiner*—Mickey Yu
*Assistant Examiner*—Charles H. Sam
*Attorney, Agent, or Firm*—Sughrue, Mion, Zinn, Macpeak & Seas

[57] ABSTRACT

A mouthpiece comprising an ethylene-vinyl acetate copolymer having a vinyl acetate content of from 12 to 33 wt %, and the process for producing the same comprising the steps of:

preparing a thermoplastic elastic sheet material formed to be increased in thickness from one end to the other end;

preparing a teeth impression cast of a user who is going to use a mouthpiece to be produced; and pressing said teeth impression cast against said thermoplastic elastic sheet material in a softened state so as to transfer a shape of said teeth of said user onto said thermoplastic elastic sheet material to thereby obtain a mouthpiece which is set to be thicker at a portion corresponding to a front teeth position than at a portion corresponding to a molar teeth position.

2 Claims, 3 Drawing Sheets

MOUTHPIECE AND METHOD FOR PRODUCING THE SAME

BACKGROUND OF THE INVENTION

The present invention relates to a mouthpiece which can be exclusively used by a specified user and which can protect jaw bone, teeth, and an oral cavity from external force properly in view of moldability, flexibility, and elasticity. The present invention further relates to a method of producing such a mouthpiece as described above in a simple manner.

Conventionally, in such an contact sport such as rugby football or the like, an accident, for example, fracture of jaw bone, a laceration of soft tissue of an oral cavity, or the like, has frequently happened. Accordingly, in order to prevent such an accident, it is desired to put a mouthpiece in a mouth. Further, a mouthpiece has been used as a medical instrument for preventing gnashing, for treating temporomandibular disorders, or the like. Such a mouthpiece is formed by a rubbery elastic material as described, e.g., in Japanese Patent Application (OPI) No. 100273/86 (the term "OPI" used herein means a published unexamined Japanese patent application).

Such a mouthpiece formed of a rubbery elastic material, however, has a disadvantage in that the mouthpiece has not a sufficient impact absorption effect and that it is difficult to perfectly fit the mouthpiece in a mouth. That is, since a rubber material used, mouthpieces are poor in moldability, and since it is impossible to easily make moldings for exclusive use for specified users, a mouthpiece which is satisfactorily good in condition in use and which is satisfactorily proper in flexibility as well as in elasticity has not been obtained although some improvements have been proposed as described, e.g., in U.S. Pat. No. 3,073,300.

Generally, such a mouthpiece as described above is produced in such a manner as follows. First, an impression of teeth of an objective user is modeled by using a dental impression material, such as an alginate impression material, so as to form a plaster cast of the teeth, and a thermoplastic elastic rubbery elastic material shaped into a plate having a thickness of about from 1 to 3 mm is softened by heating and applied to the plaster cast to thereby obtain a mouthpiece through a vacuum molding process. Being molded with such a rubbery elastic material shaped into a plate even in thickness in all portions, the mouthpiece is also even in thickness in portions corresponding to a front teeth portion and a molar teeth portion, or has such a condition that the portion corresponding to the front teeth portion becomes thinner upon molding than the portion corresponding to the molar teeth portion because the front teeth are shaper than the molar teeth, so that there is a tendency that occlusion force at the molar teeth portion is exceedingly larger than that at the front teeth portion occluding.

In normal occlusion, however, a space between the front teeth portions of upper and lower jaws immediately before occlusion is about twice as wide as that between the molar teeth portions of the upper and lower jaws, so that occlusion force at the molar teeth portion is larger than that at the front teeth portion. Accordingly, there is a disadvantage in that strain may be generated in jaw bone or temporomandibular joint in the case where a mouthpiece is put in a mouth rather than the case without a mouthpiece.

It has been therefore desired to provide a method of producing a mouthpiece having a thickness which is larger at a portion corresponding to a front teeth position than at a portion corresponding to a molar teeth position.

SUMMARY OF THE INVENTION

It is therefore a first object of the present invention to provide a mouthpiece which has a sufficient impact absorption effect and which is perfectly fitted in a mouth so as to provide a good condition in use.

It is a second object of the present invention to provide a method for producing a mouthpiece having a thickness which is larger at a portion corresponding to a front teeth position than at a portion corresponding to a molar teeth position.

Other objects of the present invention will appear more fully from the following description.

As a result of various investigations by the present inventors, the first object of the present invention has been effectively attained by a mouthpiece comprising an ethylene-vinyl acetate copolymer.

Furthermore, the second object of the present invention has been effectively attained by the method for producing a mouthpiece which comprises the steps of preparing a thermoplastic elastic sheet material formed to be increased in thickness from one end to the other end; preparing a teeth impression cast of a user who is going to use a mouthpiece to be produced; and pressing the teeth impression cast against the thermoplastic elastic sheet material in a softened state so as to transfer a shape of the teeth onto the thermoplastic elastic sheet material to thereby obtain a mouthpiece which is set to be thicker at a portion corresponding to a front teeth position than at a portion corresponding to a molar teeth position.

BRIEF DESCRIPTION OF THE DRAWINGS

The present invention will be apparent from the following detailed description taken in conjunction with the accompanying drawings, in which.

DETAILED DESCRIPTION OF THE INVENTION

Figure 1:
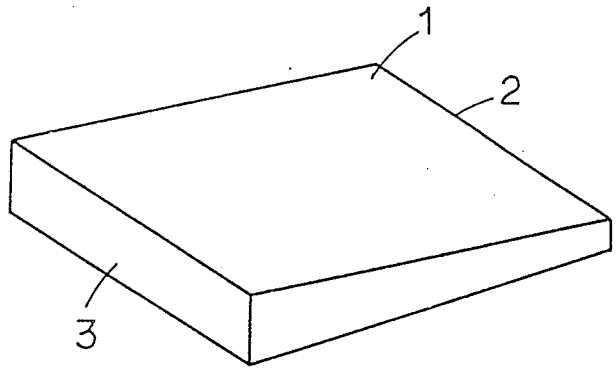
FIGS. 1 through 3 are perspective view showing examples of thermoplastic elastic sheet materials used in the producing method according to the present invention.

The mouthpiece according to the present invention is produced by using an ethylene-vinyl acetate copolymer. Accordingly, the softening point of the ethylene-vinyl acetate copolymer can be adjusted by changing the content of the vinyl acetate, so that it is possible to provide a satisfactory mouthpiece improved in moldability and provided with flexibility and elasticity. The vinyl acetate is contained for adjusting moldability and flexibility of the ethylene-vinyl acetate copolymer. For example, the larger content of vinyl acetate in the copolymer provides the smaller rigidity modulus, the higher flexibility, the lower heat deformation temperature and the better moldability at a low temperature. In view of the above, it is preferred that the content of the vinyl acetate is from 12 to 33 wt %, more preferably from 28 to 33 wt %.

The ethylene-vinyl acetate copolymer used in the present invention can be prepared by any conventional methods known in this field of art, such as those described in Hiroshi Iwasaki, Kobunshi Kako (Process for Highmolecules), Separate Volume V (August 1969), pp 9 et seq and ditto, pp 49 et seq.

The ethylene-vinyl acetate copolymer used in the present invention may contain various coloring substance such as organic dyes and inorganic pigments.

As a material for producing a mouthpiece, it is generally considered to use rubber or thermoplastic soft synthetic resin. However, low density polyethylene is inferior in elongation although superior in moldability as well as in impact strength. Polypropylene is relatively inferior in impact strength although superior in moldability as well as in elongation. Vinyl chloride is inferior in moldability, and relatively inferior in elongation as well as in impact strength. Fluororesin is inferior in moldability, and relatively inferior in elongation.

The present inventors, however, have found that an ethylene-vinyl acetate copolymer has suitable characteristics for a mouthpiece in moldability, in elongation, and in impact strength. Particularly, the moldability, flexibility and elasticity of the copolymer can be adjusted by changing the content of vinyl acetate of the ethylene-vinyl acetate copolymer as described above, so that it is possible to mold a mouthpiece for exclusive use for a specified user which provides good feeling as well as good fitness to a mouth in use.

In the present invention, the ethylene-vinyl acetate copolymer containing vinyl acetate in an amount of from 12 to 33 wt % is used. This is because the copolymer having a vinyl acetate content of less than 12 wt % is inferior in impact resistance so as to be inferior in practical use as well as in moldability, and the copolymer having a vinyl acetate content of more than 33 wt % is soft and inferior in strength and in practical use.

A mouthpiece is made of ethylene-vinyl acetate copolymer resin suitably in such a manner as follows. First, a plate having a thickness of about from 1 to 5 mm is formed of the foregoing resin, and the plate is heated. Next, the heated resin plate is vacuum molded by using a plaster cast formed from teeth of a specified user to thereby obtain a mouthpiece suitably fitted to the oral cavity of the user. In production, the mouthpiece according to the present invention can be obtained in such a manner that the foregoing resin is pre-molded in a horseshoe shape along a row of teeth, or the thus pre-molded resin is softened by heating so as to be easily molded in the oral cavity of the user.

Further, a space between upper and lower front teeth positions of the user is larger than that between upper and lower molar teeth positions in the mouth. Accordingly, as the mouthpiece according to the present invention, it is preferred to form a mouthpiece in which a portion corresponding to the front teeth position is set to be thicker than that corresponding to the molar teeth position. Such a mouthpiece can be produced by the mouthpiece producing method according to the present invention described below.

That is, in the method for producing a mouthpiece according to the present invention, a thermoplastic elastic sheet material having a thickness increased from one end to the other end is pressed to be molded in a softened state against the teeth impression cast of the mouthpiece user, so that the thickness of the molded mouthpiece can be set to be thicker at a portion thereof corresponding to the front teeth position of the user than portion corresponding to the molar teeth position of the user.

In the above method for producing a mouthpiece according to the present invention, essentially, the mouthpiece is produced by using a thermoplastic elastic sheet material having a thickness increased from one end to the other end and being in the softened condition by heating. Examples of the thermoplastic elastic sheet material include an ethylene-vinyl acetate copolymer, low density polyethylene, polypropylene, vinyl chloride, fluororesin, and the like. It is, however, preferred to use ethylene-vinyl acetate copolymer resin.

Figure 2:
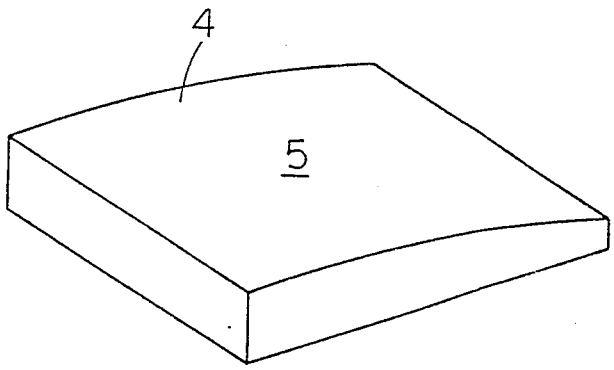
Figure 3:
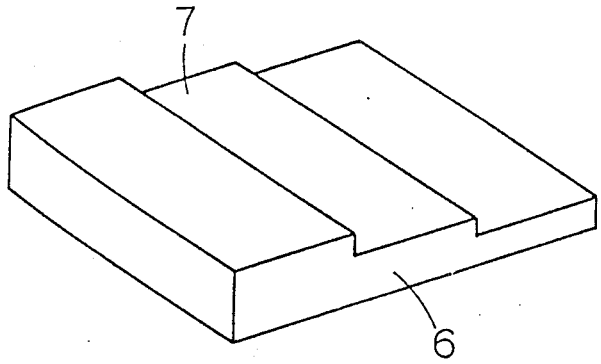

In the method for producing a mouthpiece according to the present invention, the thermoplastic elastic sheet material is molded into such a sheet, for example, as shown in FIGS. 1, 2 or 3. The sheet is softened by heating and the sheet in a softened state is molded in the next step to thereby obtain a mouthpiece. FIG. 1 shows a thermoplastic elastic sheet 1 having a thickness linearly increased from one end 2 to the other end 3. FIG. 2 shows another thermoplastic elastic sheet 4 having a surface 5 which is curved so that the thickness of the sheet is increased from one end to the other end. FIG. 3 shows still another thermoplastic elastic sheet 6 having a thickness 7 which is stepwise increased from one end to the other end.

That is, each of these elastic sheet materials 1, 4, and 6 respectively shown in FIGS. 1 through 3 is shaped so as to have a thickness which is increased from one end to the other end. The thick and thin portion sides of each of the elastic sheet material 1, 4, and 6 are set as portions corresponding to the front and molar teeth positions of the user, respectively. Then, each of the elastic sheet material 1, 4, and 6 is vacuum molded by using a teeth impression cast of the mouthpiece user so as to transfer the teeth shape of the user onto the elastic sheet material to thereby make it possible to obtain a mouthpiece in which a portion corresponding to the front teeth position is set to be thicker than that corresponding to the molar teeth position.

In such a method for producing a mouthpiece as described above, it is made possible to easily rapidly mold a mouthpiece in which the front teeth side is set to be thick and the molar teeth side is set to be thin as described above.

By using ethylene-vinyl acetate copolymer resin containing vinyl acetate of from 12 to 33 wt % and having a low softening point as the elastic sheet material, it is possible to improve moldability in forming a mouthpiece for exclusive use for a specified user and it is possible to provide suitable flexibility and elasticity to a molded mouthpiece.

Description will be made hereunder in detail as to various examples according to the present invention, however, the present invention is not limited to those examples.

EXAMPLE 1

Plates (width: 130 mm×130 mm×thickness: 2 mm) were formed by using ethylene-vinyl acetate copolymer resin containing vinyl acetate with compositions as shown in Table 1.

TABLE 1

| Sample No. | Vinyl acetate content (wt %) |
|---|---|
| 1 | 33 |
| 2 | 28 |
| 3 | 19 |
| 4 | 12 |
| 5 | 40 |
| 6 | 8 |
| 7 | 6 |

Figure 4:
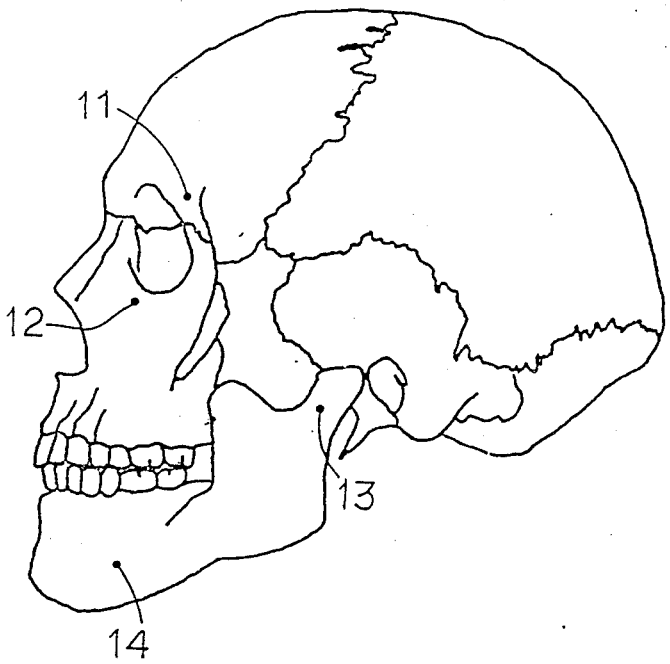
FIG. 4 is a side view showing a cranium used in the experiments for the mouthpiece according to the present invention.

The impact absorption effect as a mouthpiece was measured by using those seven kinds of plates. The impact absorption effect was measured by using an adult cranium perfectly having teeth. An impression of an upper jaw of the cranium was modelled in a silicon impression material, and a plaster cast was formed from the impression. Mouthpieces for used for the upper jaw were formed by using the foregoing seven kinds of samples through a vacuum molding process. In order to measure main strain in various portions of the cranium of FIG. 4, strain gages were stuck to four points represented by the reference numerals 11 through 14 in FIG. 4, and the cranium was fixed at its parietal portion by using an iron frame. In this state, a load of 3 kg was applied perpendicularly to an impartial mental region and strain was measured. The Table 2 shows values of main strain at the various portions using the mouthpieces formed from the samples. In addition, a commercial mouthpiece (Mouthpiece for sports, #F2 made by Winning Co., Ltd.) was tested in the same manner as above, and the results obtained are also shown in Table 2. In the Table 2, strain when no mouthpiece is used is represented as 100%.

TABLE 2

| Sample No. | Main Strain | | | |
|---|---|---|---|---|
| | Portion 11 (%) | Portion 12 (%) | Portion 13 (%) | Portion 14 (%) |
| Non-use | 100 | 100 | 100 | 100 |
| 1 | 13 | 34 | 92 | 88 |
| 2 | 40 | 44 | 52 | 84 |
| 3 | 35 | 38 | 34 | 23 |
| 4 | 87 | 30 | 35 | 46 |
| 5 | 768 | 138 | 24 | 27 |
| 6 | 139 | 74 | 30 | 68 |
| 7 | 1,061 | 144 | 66 | 88 |
| Commercial mouthpiece | 878 | 151 | 16 | 49 |

As seen from the Table 2, in the case where main strain is assumed to be 100% when no mouthpiece is put in a mouth, it was found that each of the mouthpieces produced by using the ethylene-vinyl acetate copolymers shown as the samples 1 through 4 have a high impact absorption effect.

EXAMPLE 2

Next, moldability and practicality of the mouthpieces were measured while changing the content of vinyl acetate. Table 3 shows the result of measurement.

TABLE 3

| Content of vinyl acetate (wt %) | Moldability | Practicality |
|---|---|---|
| 8 | B | B |
| 12 | A | A |
| 19 | A | A |
| 28 | A | A |
| 33 | A | A |
| 38 | A | B |
| Commercial mouthpiece (same as in Example 1) | B | A |

The moldability in Table 3 was evaluated to the grades A (good) and B (not good) by the following manner. The ethylene-vinyl acetate plates and the commercial mouthpiece material were heated in boiling water for 5 minutes, and then vacuum molded using a teeth model to prepare mouthpieces. While observing the facies occlusalis of the mouthpieces, those having facies occlusalis sufficiently well molded were evaluated as A, and those having facies occlusalis insufficiently molded were evaluated as B.

The practicality in Table 3 was organoleptically evaluated to the grades A (good) and B (not good) by the practical use. Specifically, upon using the sample of vinyl acetate content of 8 wt %, the mouthpiece was felt hard, and the gums hurt where the mouthpiece touched the gums. Moreover, because of the deteriorated moldability, the mouthpiece having a vinyl acetate content of 8 wt % was not sufficiently fitted in the mouth and rattled upon using. The mouthpiece having a vinyl acetate content of 38 wt % was soft and broken by normal occlusion.

The moldability shows the fact that a softening point of the ethylene-vinyl acetate copolymer changes in accordance with the content of the vinyl acetate contained in the ethylene-vinyl acetate copolymer in such a manner that the softening point becomes high as the content of the vinyl acetate decreases while the softening point becomes low as the content increases. Therefore, in view of the moldability in forming a mouthpiece for exclusive use for a specified user, it is preferred to contain vinyl acetate by a quantity within a range of from 12 to 38 wt % in the ethylene-vinyl acetate copolymer. Softness of the mouthpiece changes in accordance with the content of the vinyl acetate in such a manner that the mouthpiece becomes hard when the content is equal to 8 wt % while becomes soft when the content is equal to 38 wt %. That is, it was found that when the content of vinyl acetate falls within a range of from 12 to 33 wt %, the mouthpiece shows more satisfactory characteristics in view of moldability as well as practicality as to softness, so that a particularly good result can be obtained in the use of the mouthpiece.

EXAMPLE 3

By using the ethylene-vinyl acetate copolymer resins used for the samples Nos. 1 to 4, plates having compositions shown in Table 4 in which the thickness increased from one end to the other end (width: 130 mm×130 mm×thickness: 2 to 5 mm) were formed, and designated the samples Nos. 1′, 2′, 3′, and 4′.

TABLE 4

| Sample No. | Vinyl acetate content (wt %) |
|---|---|
| 1′ | 33 |
| 2′ | 28 |
| 3′ | 19 |
| 4′ | 12 |

Mouthpieces were prepared in the same manner as in Example 1 by using the plates of the samples Nos. 1 to 4 and 1' to 4'. The thickness of the portion corresponding to the front teeth portion and the thickness of the portion corresponding to the molar teeth portion of the mouthpieces thus prepared were measured. The results obtained are shown in Table 5.

TABLE 5

| Sample No. | Thickness: Front teeth portion (mm) | Thickness: Molar teeth portion (mm) |
|---|---|---|
| 1 | 1.0 | 1.0 |
| 2 | 1.0 | 1.5 |
| 3 | 1.0 | 1.2 |
| 4 | 1.1 | 1.1 |
| 1' | 3.0 | 2.0 |
| 2' | 3.0 | 2.0 |
| 3' | 3 5 | 2.1 |
| 4' | 3.1 | 2.5 |

From the results in Table 5, it was found that in the mouthpieces prepared by using the plates in which the thickness increased from one end to the other end (samples Nos. 1' to 4'), the thickness of the portion corresponding to the front teeth portion was thicker than that corresponding to the molar teeth portion.

The samples Nos. 1' to 4' were measured for the impact absorption effect in the same manner as in Example 1. The results obtained are shown in Table 6 with the results of the samples Nos. 1 to 4.

TABLE 6

| Sample No. | Main strain: Position 11 (%) | Main strain: Position 12 (%) |
|---|---|---|
| Non-use | 100 | 100 |
| 1 | 13 | 34 |
| 1' | 9 | 22 |
| 2 | 40 | 44 |
| 2' | 35 | 21 |
| 3 | 35 | 38 |
| 3' | 25 | 30 |
| 4 | 87 | 30 |
| 4' | 90 | 39 |

It is apparent from Table 6 above that the mouthpieces prepared by using the plates in which the thickness increases from one end to the other end (samples Nos. 1' to 4') have a particularly excellent impact absorption effect. It is considered that this is because the occlusion force is uniformly dispersed at the portions of from the molar teeth portion to the front teeth portion.

The samples Nos. 1' to 4' were measured for the moldability and the practicality in the same manner as in Example 2, and as the result, a good moldability and a good practicality were obtained in all the samples Nos. 1' to 4'.

As described above, the mouthpiece according to the present invention is formed by using an ethylene-vinyl acetate copolymer, so that the moldability, flexibility, and elasticity of the ethylene-vinyl acetate copolymer can be adjusted by changing the content of the vinyl acetate, and a mouthpiece having a proper shape and providing good fitting feeling in a mouth can be provided for exclusive use for a specified user.

Further, the producing method according to the present invention is featured in that the method comprises the steps of preparing a thermoplastic elastic sheet material formed to be increased in thickness from one end to the other and; preparing a teeth impression cast of a user who is going to use a mouthpiece to be produced; and pressing the teeth impression cast against the thermoplastic elastic sheet material in a softened state so as to transfer a shape of the teeth of the user onto the thermoplastic elastic sheet material to thereby obtain a mouthpiece which is set to be thicker at a portion corresponding to a molar teeth position. Accordingly, in order to produce a mouthpiece having a thickness which is set to be thicker at a portion corresponding to the front teeth position than at a portion corresponding to the molar teeth position, a thermoplastic elastic sheet material which is changed in thickness from one end to the other end is used, so that a space between the upper and lower teeth portions is accurately transferred to the mouthpiece so as to realize comfortable feeling in use of the mouthpiece, and that the mouthpiece can perfectly protects teeth as well as an oral cavity.

While the invention has been described in detail and with reference to specific examples thereof, it will be apparent to one skilled in the art that various changes and modifications can be made therein without departing from the spirit and scope thereof.

What is claimed is:

1. A method for producing a mouthpiece comprising the steps of:

preparing a thermoplastic elastic sheet material formed to be increased in thickness from one end to the other end, said elastic sheet material comprising an ethylene-vinyl acetate copolymer having a vinyl acetate content of from 12–33 wt %;

preparing a teeth impression cast of a user who is going to use a mouthpiece to be produced; and pressing said teeth impression cast against said thermoplastic elastic sheet material in a softened state, in such a position so that the thicker portion of said thermoplastic sheet material is at the front teeth position, so as to transfer a shape of said teeth of said user onto said thermoplastic elastic sheet material to thereby obtain a mouthpiece which is set to be thicker at a portion corresponding to a front teeth position than at a portion corresponding to a molar teeth position.

2. A method of producing a mouthpiece as claimed in claim 1, wherein an ethylene-vinyl acetate copolymer having a vinyl acetate content of from 28 to 33 wt % is used as said elastic sheet material.

* * * * *